US006634032B1

(12) United States Patent
Janik

(10) Patent No.: US 6,634,032 B1
(45) Date of Patent: Oct. 21, 2003

(54) HYGIENE TOILET SEAT INSERT AND LID HANDLE

(76) Inventor: Ernest A. Janik, 600 N. St. Paul Suite 2255, Dallas, TX (US) 75201

( * ) Notice: Subject to any disclaimer, the term of this patent is extended or adjusted under 35 U.S.C. 154(b) by 0 days.

(21) Appl. No.: 10/326,677

(22) Filed: Dec. 21, 2002

(51) Int. Cl.[7] ..... A47K 13/10
(52) U.S. Cl. ..... 4/246.1
(58) Field of Search ..... 4/246.1, 228.1, 4/229, 230, 233, 234, 237

(56) References Cited

U.S. PATENT DOCUMENTS 3,191,193 A * 6/1965 Bogenberger ..... 4/246.1
3,783,455 A * 1/1974 Vanderbrook ..... 4/237
4,574,401 A * 3/1986 Nakajima ..... 4/246.1
4,979,238 A * 12/1990 Clark ..... 4/246.1
5,086,523 A * 2/1992 De Mott et al. ..... 4/246.1
5,590,425 A * 1/1997 Janik, Jr. ..... 4/246.1

* cited by examiner

*Primary Examiner*—Tuan N. Nguyen
(74) *Attorney, Agent, or Firm*—H. Dennis Kelly; Jeffrey T. Hubbard; Kelly & Hubbard

(57) ABSTRACT

A toilet seat handle adapted to fit within an opening in a toilet seat or lid. The toilet seat handle comprises an inner tab adapted to be inserted into an opening in a toilet seat or lid. A finger grip attaches to the inner tab and extending outward from the opening in the toilet seat or lid. A spongy material housed with the finger grip for holding a quantity of disinfectant to be dispensed through a cavity in the finger grip.

5 Claims, 3 Drawing Sheets

HYGIENE TOILET SEAT INSERT AND LID HANDLE

BACKGROUND OF THE INVENTION

1. Field of the Invention

This invention relates in general to handles for toilet seats and lids. In particular, the invention relates to a toilet seat handle for use with a toilet seat or lid for deodorizing and disinfecting the toilet bowl and for providing hygienic means for raising and lowering the toilet seat or lid.

2. Description of Related Art

U.S. Pat. No. 5,590,425, issued Jan. 7, 1997 to Janik, Jr., discloses a toilet seat handle that fits into a base that is attached to the under side of a toilet seat or toilet lid. The toilet seat handle itself is tapered to friction fit within the base to hold the handle in place temporarily. The handle has upper and lower lips, but the lips are planar on the front side and there is no cushion between the lip and the toilet seat.

U.S. Pat. No. 3,191,193, issued Jun. 29, 1965 to Bogenberger, discloses a toilet seat handle containing a deodorizing and disinfecting wafer. The handle attaches to the underside of the toilet seat, and extends outward beyond the edge of the toilet seat.

SUMMARY OF THE INVENTION

The general object of the toilet seat handle of the invention is to provide a handle that is easily inserted into and removed from an opening in a toilet seat or a toilet lid. The toilet seat handle of the invention has an inner tab that is inserted into an opening in a toilet seat or a toilet lid. A finger grip, attached to the inner tab, extends outward from the opening to provide a handy grip. A spongy material, housed with the finger grip, holds a quantity of disinfectant to be dispensed through a cavity in the finger grip. The finger grip has an upper lip and a lower lip with cushions to provide a complete abutment with the toilet seat or toilet lid. A layer of adhesive on the cushions will hold the toilet seat handle within the opening temporarily until the toilet seat handle is to be replaced.

The above, as well as additional objects, features, and advantages of the invention will become apparent in the following detailed description.

DESCRIPTION OF THE PREFERRED EMBODIMENT

The preferred embodiment of the invention for use with a toilet seat 11 or a lid 13 is illustrated in FIGS. 1–7. Both the toilet seat 11 and the lid 13 are designed to be used on a typical toilet 15 in a conventional manner.

Figure 1:
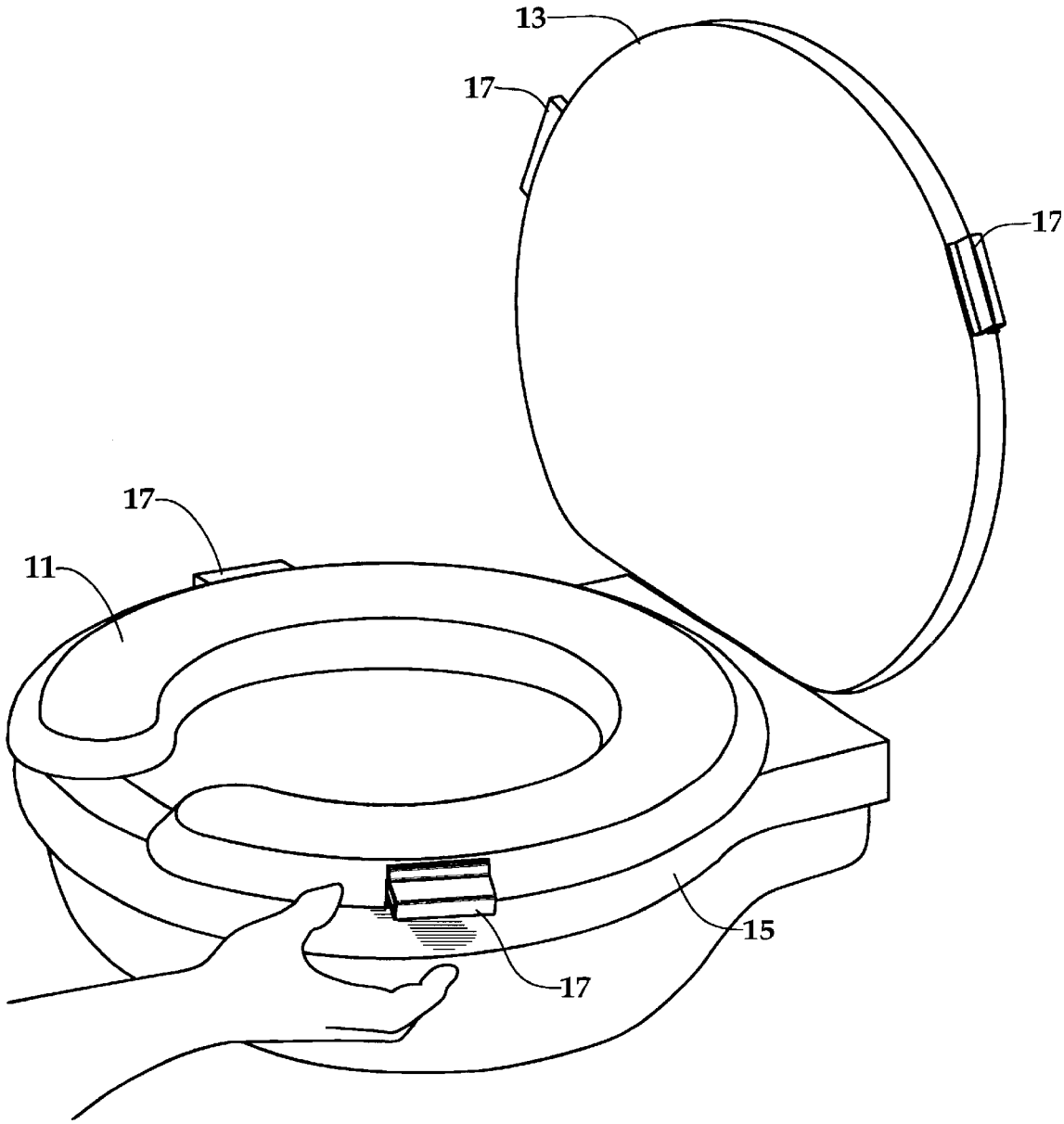
FIG. 1 is a perspective view of four toilet seat handles according to the invention, two in use with a toilet seat and two in use with a toilet seat lid.

The toilet seat 11 and the lid 13 each has a pair of hygiene handles 17 as shown in FIG. 1. The handles 17 fit within openings 19 on either side of the seat 11 and lid 13. Alternatively, any of the handles 17 may be replaced with a cover (not shown) to cover that particular opening 19 in the absence of the handle 17.

Figure 2:
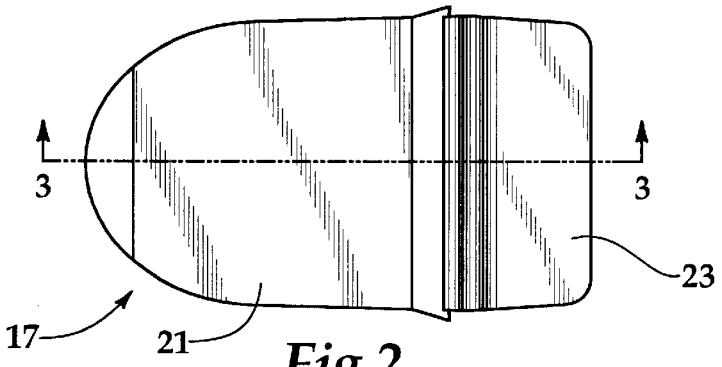
FIG. 2 is a top plan view of one toilet seat handle according to the invention.
Figure 3:
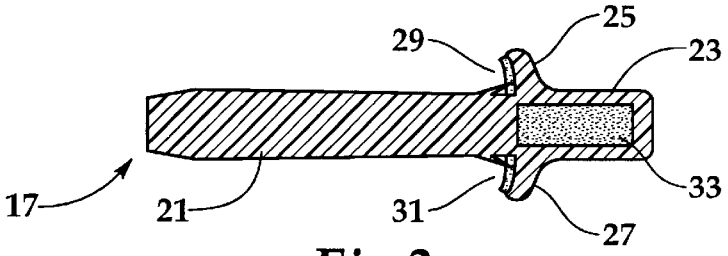
FIG. 3 is a cross-sectional view of the toilet seat handle as seen along lines 3—3 in FIG. 2.
Figure 4:
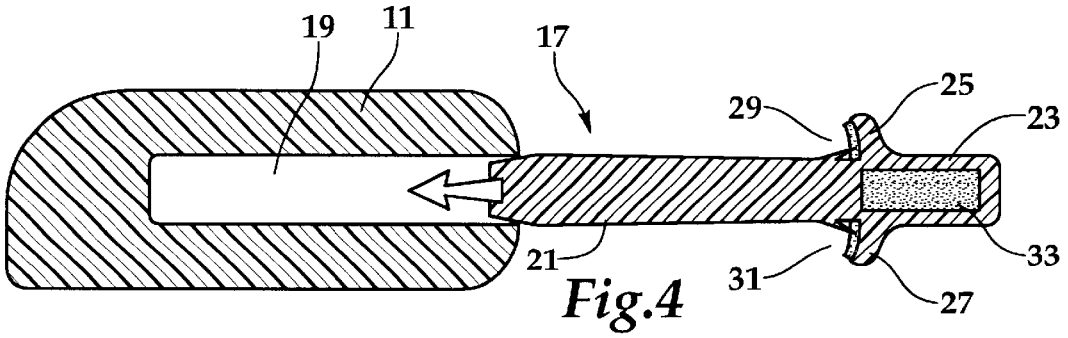
FIG. 4 is a cross-sectional view of the toilet seat handle being inserted into an opening in a toilet seat or lid.
Figure 5:
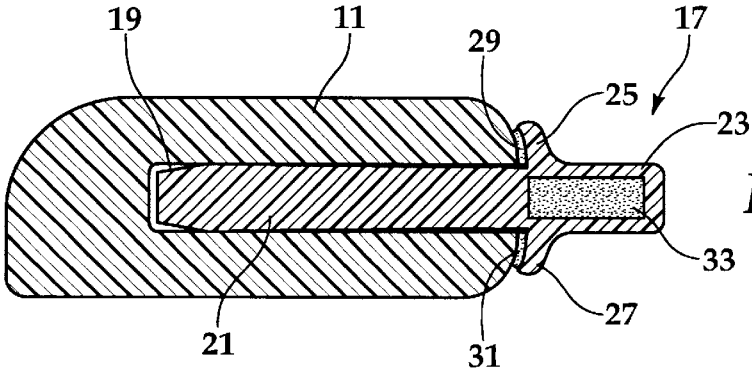
FIG. 5 is a cross-sectional view of the toilet seat handle completely inserted into an opening in a toilet seat or lid.
Figure 6:
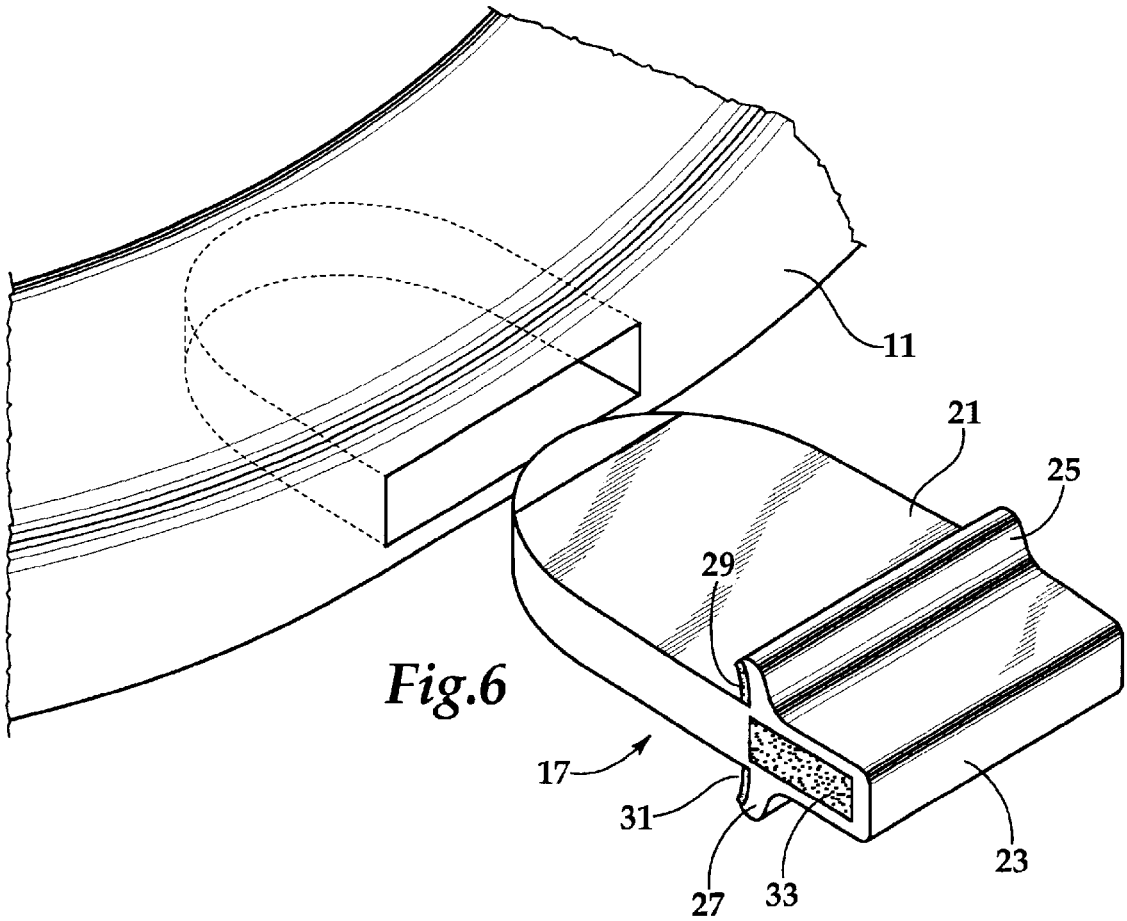
FIG. 6 is a perspective view of a toilet seat handle being inserted into an opening in a toilet seat or lid.
Figure 7:
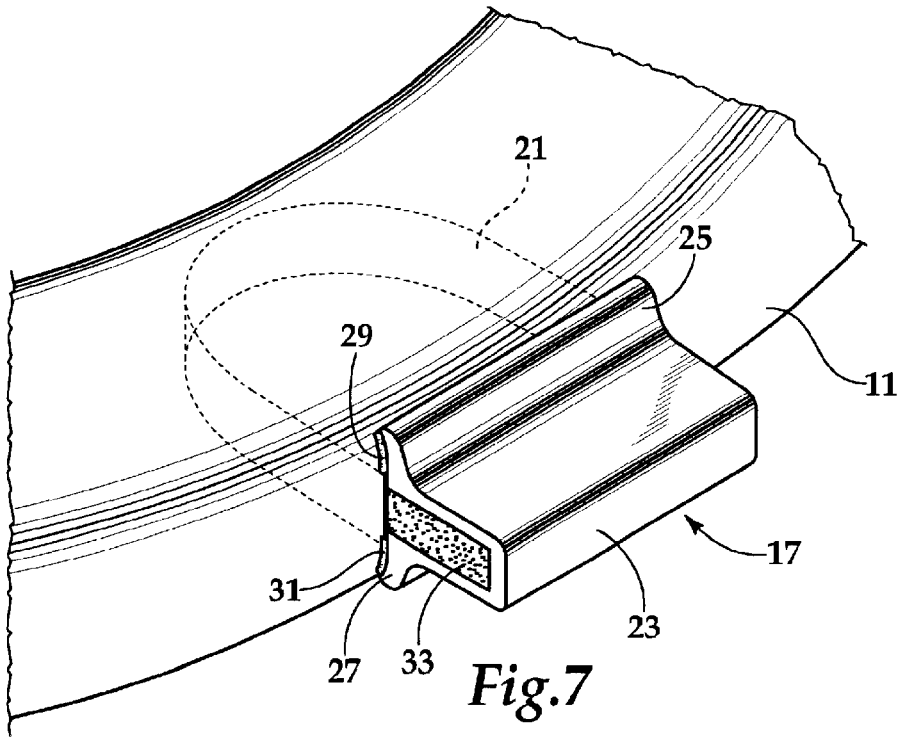
FIG. 7 is a perspective view of the toilet seat handle in place within the opening in a toilet seat or lid.

One of the handles 17 is shown in more detail in FIGS. 2–7, although the handles 17 are identical. Each handle 17 has an inner tab 21 and a finger grip 23. The inner tab 21 of the handle 17 is shaped to fit securely within one of the openings 19 in the seat 11 or the lid 13. The actual shapes of the inner tab 21 and the opening 19 may vary widely, but the preferred shape is rectangular with a rounded end, as shown in FIGS. 2, 6, and 7.

The finger grip 23 of the handle 17 is preferably rectangular, as well, and is wide enough to allow a person to easily grip the finger grip 23. This allows the handle 17 to be easily installed and removed from the opening 19.

An upper lip 25 extends across the width of the upper side of the finger grip 23. Similarly, a lower lip 27 extends across the width of the lower side of the finger grip 23. An upper cushion 29, adhesively attached to the front of the upper lip 25, provides a complete abutment between the toilet seat handle 17 and the toilet seat 11. A lower cushion 31 is similarly attached to the lower lip 27 and also provides a complete abutment with the toilet seat 11.

A optional adhesive coating preferably treated with a disinfectant and a deodorant can be applied to the front of the upper cushion 29 and the front of the lower cushion 31 in order to temporarily secure the toilet seat handle 17 to the toilet seat 11 or the lid 13. This adhesive is preferably of a type that will hold the cushions 29 and 31 to the toilet seat 11 or lid 13 securely, but that will allow easy removal when the toilet seat handle 17 is to be replaced.

A spongy material 33 is housed within the finger grip 23, as shown in FIGS. 3–7. This spongy material 33 contains a disinfectant that is dispensed through a cavity on each side of the finger grip 23. The exact sizes and shapes of these cavities may be varied, but they should allow the disinfectant to be dispensed whenever the toilet seat handle 17 is used.

The handle 17 of the invention is installed by inserting the handle 17 onto gripping the handle 17 by the finger grip 23 and the inner tab 21 is inserted into the opening 19. The finger grip 23 is then in a convenient location to be used for opening or closing the toilet seat 11 or lid 13. Disinfectant and deodorant in the spongy material 33 is dispensed to disinfect the handle 17 and the surrounding seat 11 or lid 13.

The handle 17 of the invention has several advantages over the prior art. The handle 17 is easily installed, especially since the openings 19 are drilled when the toilet seat 11 or lid 13 is originally manufactured. Further, the handle 17 provides convenient, safe, and clean means for lifting or lowering the toilet seat 11 or lid. The handle 17 thus provides for a safer, cleaner, and more convenient toilet 15.

The invention has been described in only a few embodiments. It should be apparent to those skilled in the art that the invention is not so limited, but is susceptible to various changes and modifications without departing from the spirit of the invention.

I claim:

1. A toilet seat handle adapted to fit within an opening in a toilet seat or lid, wherein the toilet seat handle comprises:

an inner tab adapted to be inserted into an opening in a toilet seat or lid;

a finger grip attached to the inner tab and extending outward from the opening in the toilet seat or lid;

an upper lip on the finger grip;

an upper cushion located in front of the upper lip for providing a complete abutment with the toilet seat or lid when the toilet seat handle is in place;

an adhesive on the upper cushion to temporarily adhere the upper cushion to the toilet seat; and a spongy material housed with the finger grip for holding a quantity of disinfectant to be dispensed through a cavity in the finger grip.

2. A toilet seat handle as recited in claim 1, further comprising:

a lower lip on the finger grip; and a lower cushion located in front of the lower lip for providing a complete abutment with the toilet seat when the toilet seat handle is in place.

3. A toilet seat handle as recited in claim 2, further comprising an adhesive on the lower cushion to temporarily adhere the lower cushion to the toilet seat.

4. A toilet seat handle as recited in claim 1, wherein the spongy material also holds a quantity of deoderant.

5. A toilet seat handle adapted to fit within an opening in a toilet seat or lid, wherein the toilet seat handle comprises:

an inner tab adapted to be inserted into an opening in the toilet seat or lid;

a finger grip attached to the inner tab and extending outward from the opening in the toilet seat or lid;

a spongy material housed with the finger grip for holding a quantity of disinfectant to be dispensed through a cavity in the finger grip;

an upper lip on the finger grip;

an upper cushion located in front of the upper lip for providing a complete abutment with the toilet seat or lid when the toilet seat handle is in place;

a lower lip on the finger grip; and a lower cushion located in front of the lower lip for providing a complete abutment with the toilet seat or lid when the toilet seat handle is in place.

* * * * *